US007530173B2

(12) United States Patent
Economaki

(10) Patent No.: US 7,530,173 B2
(45) Date of Patent: May 12, 2009

(54) VARIABLE CUTTING ANGLE HAND PLANE

(76) Inventor: John J. Economaki, 820 Timberline Dr., Lake Oswego, OR (US) 97034

( * ) Notice: Subject to any disclaimer, the term of this patent is extended or adjusted under 35 U.S.C. 154(b) by 142 days.

(21) Appl. No.: 11/214,127

(22) Filed: Aug. 29, 2005

(65) Prior Publication Data

US 2007/0044328 A1 Mar. 1, 2007

(51) Int. Cl.
*B27G 17/02* (2006.01)

(52) U.S. Cl. ..... 30/481; 30/487; 30/490

(58) Field of Classification Search ..... 30/481, 30/487, 490

See application file for complete search history.

(56) References Cited

U.S. PATENT DOCUMENTS

| | | | | | |
|---|---|---|---|---|---|
| 13,381 | A | * | 8/1855 | Bailey | 30/169 |
| 135,341 | A | * | 1/1873 | Jones | 30/169 |
| 206,698 | A | * | 8/1878 | Price | 418/165 |
| 315,014 | A | * | 4/1885 | Duncan | 30/487 |
| 316,296 | A | * | 4/1885 | Rodier | 30/492 |
| 453,524 | A | * | 6/1891 | Tuoti | |
| 1,149,703 | A | * | 8/1915 | Vaughan | |
| 1,157,594 | A | * | 10/1915 | Selleck | |
| 1,448,775 | A | * | 3/1923 | Trump | 30/491 |
| 1,507,722 | A | * | 9/1924 | Ahlen | |
| 1,559,797 | A | * | 11/1925 | Slomer | |
| 1,567,342 | A | * | 12/1925 | Szako | 30/486 |
| 1,776,661 | A | * | 9/1930 | McCue | |
| 1,964,756 | A | * | 7/1934 | Corel | 30/489 |
| 2,371,946 | A | * | 3/1945 | Benn | 30/490 |
| 2,839,109 | A | * | 6/1958 | Wilson et al. | 30/478 |
| 3,028,892 | A | * | 4/1962 | Filia | 30/487 |
| 4,015,649 | A | * | 4/1977 | Gilbert | |
| 4,252,163 | A | * | 2/1981 | Onda et al. | 144/132 |
| 4,498,513 | A | * | 2/1985 | Derivaz | 30/487 |
| 4,589,209 | A | * | 5/1986 | Zarges et al. | |
| 6,615,497 | B1 | * | 9/2003 | Saunders et al. | 30/488 |
| 2005/0061398 | A1 | * | 3/2005 | Saunders | 144/115 |
| 2005/0188553 | A1 | * | 9/2005 | Lee et al. | |

FOREIGN PATENT DOCUMENTS

| | | | |
|---|---|---|---|
| EP | 1 479 490 | A2 * | 11/2004 |
| JP | 10 193302 | * | 7/1998 |

* cited by examiner

*Primary Examiner*—Maurina Rachuba
(74) *Attorney, Agent, or Firm*—McKee, Voorhees & Sease, P.L.C.

(57) ABSTRACT

A variable cutting angle hand plane is provided. The variable cutting hand plan has a base unit configured for holding an iron, wherein the base unit has a sole and a throat extending through the base unit to the sole. The base unit has an adjustable frog for supporting the iron at multiple angles with respect to the sole. A means for engaging the iron is used for holding the iron against the adjustable frog. The hand plane may have an adjustable throat. There may be a means for indicating the approximate angle of the adjustable frog.

22 Claims, 6 Drawing Sheets

VARIABLE CUTTING ANGLE HAND PLANE

BACKGROUND OF THE INVENTION

This invention relates to woodworking tools. Specifically, this invention relates to a variable cutting angle hand plane.

Hand planes have been used for hundreds of years to smooth the surface of wood. A hand plane works when a woodworker pushes or pulls the plane across the surface of the wood which allows the sharp blade of the plane iron to engage the wood and shear off a thin layer of wood, thereby smoothing the wood surface.

FIG. 1 shows an expanded view of a prior art hand plane. The hand plane assembly 10 has a base unit 12, in which the bottom of the base unit 12 is the sole 14. In addition, the base unit 12 has an opening in the sole 14 which is called the throat 16. Attached to the base unit 12 is at least one handle or tote 18. A device called a frog 20 extends upward from the inside of the base unit 12. The frog 20 rigidly screws to the base unit 12 with two mounting screws 21. The frog 20 holds the blade or cutter which is known as the iron 28 at a preset angle (approximately 45°) with respect to the sole 14.

The user can turn the depth adjuster 22 which allows the iron 28 to extend farther through the throat 16. Adjustment of the iron 28 depth allows the iron 28 to engage a deeper or shallower cut in the wood being planed. The lateral adjuster 24 allows the user to adjust the iron 28 into a left or right position. This in turn, allows for deeper cuts on one side of the plane or the other. A bolt inserted near the center of the frog 20 is called the fulcrum stud 26. This stud 26 allows the iron 28 to be fastened securely to the frog 20, so as to make a secure, tight fit which holds the iron 28 in place during use.

In order for the iron 28 to be of use, it must be sharpened. The sharpened area on an iron 28 is called the bevel 29. Most prior art hand planes are designed in one of two ways. They either have the iron bevel-up, or the bevel-down in relation to the sole 14 of the plane. Typically planes that have a down bevel are similar to the design shown in the hand plane assembly of FIG. 1. These planes are most common and generally best for planning along the grain of the surface being planed. On the other hand, common bevel-up irons are used in a different style of hand plane (not shown) which do not have the frog. Instead, the iron 28 lays on a fixed angle inclined surface on the inside of the base unit 12 without the aid of the frog 20. This allows a bevel-up iron 28 to lie at a much more reclined angle inside the base unit 12 of the plane.

A cap iron 30 is commonly used in conjunction with the iron 28 on bevel-down type planes. The cap iron 30 is secured to the iron 28 by the use of a cap iron screw 36. This cap iron 30 acts as a chip breaker which helps to curl the cuttings cut by the iron 28 before they have a chance to split away from the larger working piece of wood. The end result is that the chip breaker part 38 on forward end of the cap iron 30 as seen in FIG. 1, which is the rounded-out bottom portion of the cap iron 30, is desirable in bevel-down type irons 28. Overall, the chip breaker contributes for much smoother cutting on the work surface of the wood. The iron 28 and the cap iron 30 when bolted together by the use of the cap iron screw 36 become one piece, which is held onto the frog 20 by the use of the lever cap 32. This lever cap has a lever 34 with a cam on the end which applies pressure against the cap iron 30 to hold the cap iron 30 and the iron 28 assembly in place on top of the frog 20. The cam on the bottom of the lever 34 causes the lever cap 32 to pivot around the fulcrum stud 26 and remain tight on the cap iron 30 and iron 28 assembly.

A low angle bevel-up type iron plane which is not shown, is commonly known to one skilled in the art. A low angle iron allows a user with the much more reclined angle on the iron (approximately 37°) to use the plane in softer types of wood or the end grain of wood. The sharper attack angle allows the plane to cut harder woods or those with more difficult grain.

Additionally, planes with a high cutting angle (approximately 90°), such as scraper planes (not shown), generally are used for scraping the top surface off the surface to be planed, such as scraping a finish or paint off the surface being planed. Thus, each type of plane, low angle, medium angle, or high angle scraper has its own specific purpose.

One problem in the prior art is that for every type of job, one needs separate hand planes to properly do the job. Therefore, it would be desirable to have one hand plane that can perform the jobs of multiple hand planes. Therefore, the primary feature or advantage of the current invention is to provide an improved variable cutting angle hand plane.

Another feature or advantage of the current invention is a hand plane suitable for using either bevel-up or bevel-down plane irons.

Another feature or advantage of the current invention is to provide a hand plane which can be used as a low angle plane, medium angle plane, and a high angle plane.

Another feature or advantage of the current invention is a hand plane which allows the throat to adjust for optimizing cutting.

A further feature or advantage is the provision of a variable cutting angle hand plane which is economical to manufacture, durable in use, and efficient in operation.

One or more of these and/or other features or advantages of the invention will be apparent from the specification and claims that follow.

SUMMARY OF THE INVENTION

One or more of the foregoing features or advantages may be achieved by a hand plane having a base unit configured for holding an iron, wherein the base unit has a sole and a throat extending through the base unit to the sole, the iron having a beveled edge for cutting the wood and further configured for the beveled edge of the iron to extend through the throat of the base unit, an adjustable frog operatively connected to the base unit that supports the iron at multiple angles with respect to the sole and, a means for engaging the iron and holding the iron against the frog. The means for engaging the iron may be an iron cap. The iron cap may pivot with respect to the base unit. The iron cap may have an articulating chip breaker which engages the iron.

Another aspect of the current invention is a hand plane with an adjustable frog which is pivotally mounted to a base unit. The adjustable frog can be supported with a moveable frog stop assembly which slides along the base unit.

Another aspect of the present invention is a hand plane having an angle indicator that approximately indicates the angle of an adjustable frog with respect to the sole.

Yet another aspect of the present invention is a hand plane having one or more adjustable throat plate(s) which allow the throat to adjust in size and location so that a user may optimize the throat as the angle of the adjustable frog changes and the protrusion of the iron through the throat changes.

A further aspect of the present invention is a hand plane with an adjustable frog which additionally comprises a depth adjuster for adjusting depth of the plane iron through the throat of the plane in the base unit.

A word that needs defined is iron. Iron does not refer to the type of material or element in which the current invention is made of. Rather, iron is a term commonly known in the art for the blade or the cutting device which actually cuts the wood for a hand plane. Therefore, a cap iron (or iron cap) is a cap that simply goes over the top of the iron, which can be made of many different materials including steel, cast iron, brass, or other similar metals.

DETAILED DESCRIPTION OF THE PREFERRED EMBODIMENT

Figure 1:
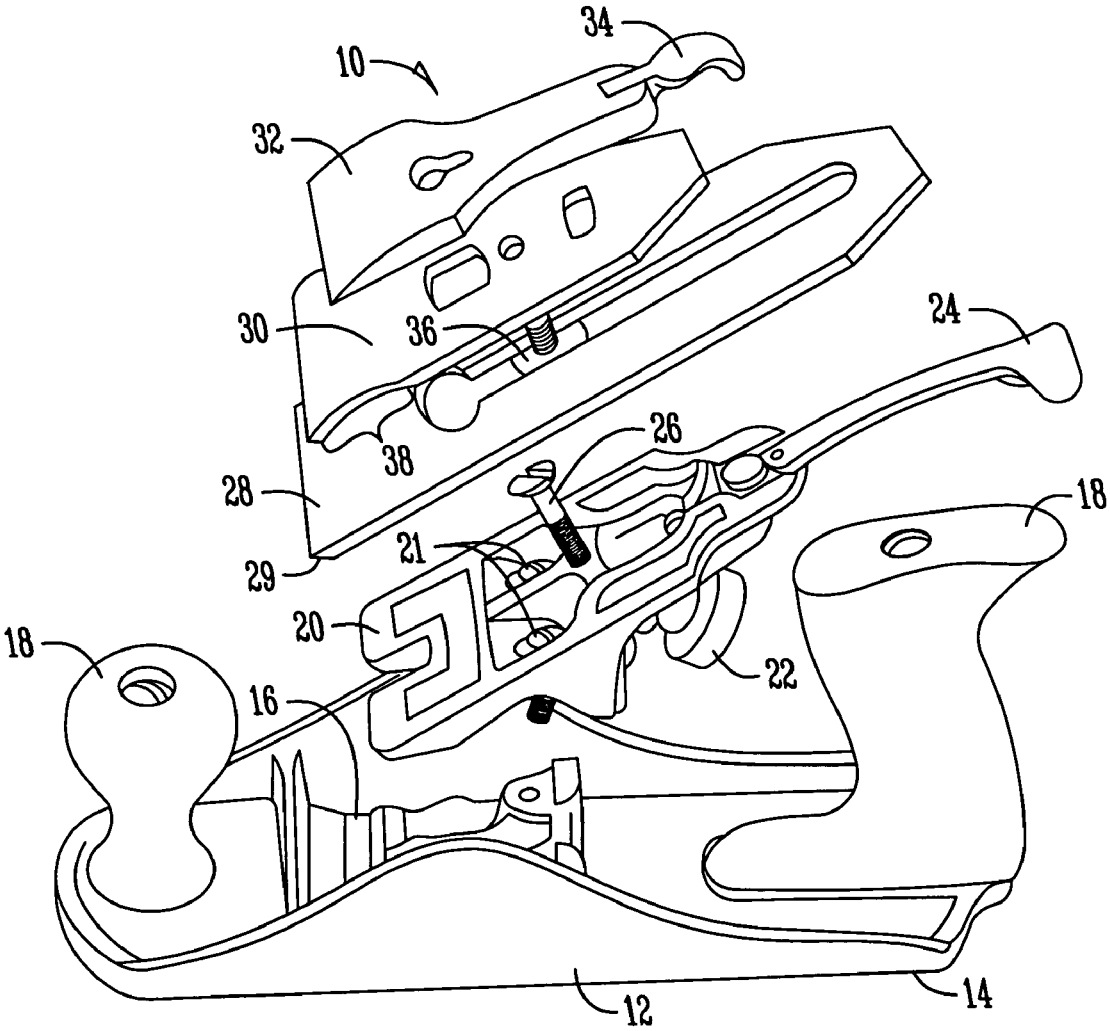
Fig. 1 (PRIOR ART)
FIG. 1 is an expanded view of a typical hand plane in the prior art.

The invention is an improved hand plane. One embodiment of the invention is shown in FIGS. 2-6. This embodiment incorporates an adjustable variable angle frog assembly 86.

This embodiment of the invention is constructed with a base unit 12 in which the underside of the base unit 12 is called the sole 14. An opening through the sole 14, is a throat 16. The throat 16 can be configured as an adjustable throat, as is common in the art. Attached to the base unit 12 is preferably one or more totes or handles 18. The totes 18 allow the user to grip the plane so they can push or pull the plane over the wood surface to be planed. The iron 28 rests on the adjustable frog 88 and extends through the throat 16. The iron 28 is held to the frog assembly 88 by an articulated iron cap assembly. The articulated iron cap assembly is constructed with an iron cap main body 64 which pivotally mounts to the base unit 12 by the iron cap assembly main pivots 74. These iron cap assembly main pivots 74 allow the articulated iron cap assembly to pivot back and forth along the iron cap assembly main pivot 74 axis.

When the tensioning bolt 62 is screwed into the iron cap main body 64, it applies pressure to the iron 28, which is supported by the adjustable frog 88. The articulating chip breaker 66, which is pivotally attached to the iron cap main body 64, then moves downward after the articulated iron cap assembly pivots about the iron cap assembly main pivot 74. Preferably, attached to the articulating chip breaker is a nose piece 68, which may or may not be extendable. If extendable, a retainer ring 78 can be used to keep the nose piece 68 from separating from the chip breaker 66. As the tensioning bolt 62 is screwed tighter into the iron cap main body 64, the nose piece 68 engages the iron 28. The tighter the tensioning bolt 62 is tightened, the tighter the pressure that is held on the iron 28. This pressure or loading allows the articulated iron cap assembly 60A to hold the iron 28 into the base unit 12 of the plane. However, other types of iron caps are contemplated and other devices for holding the plane iron 28 to the frog 88 are contemplated.

Figure 2:
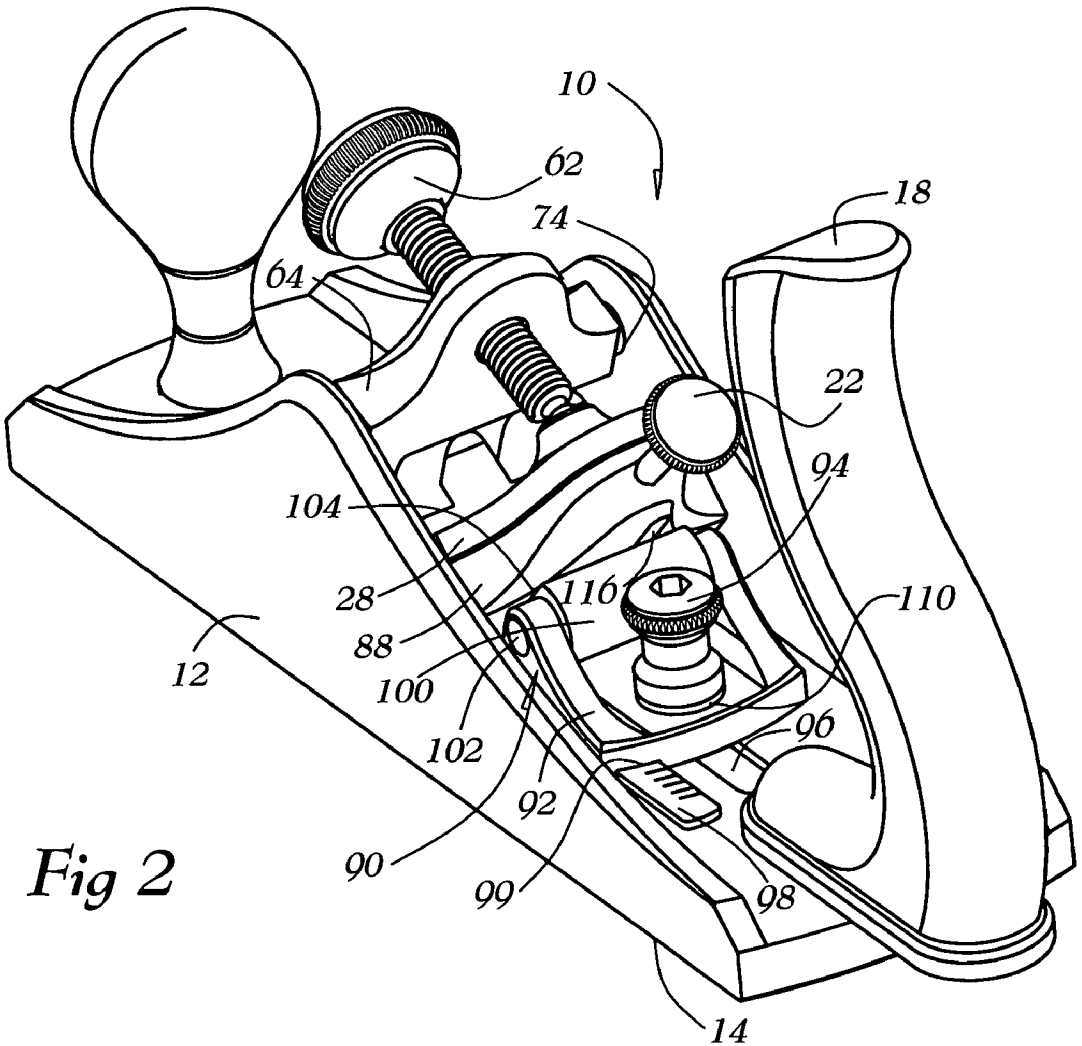
FIG. 2 shows an isometric view of one embodiment of the current invention used in a hand plane.
Figure 3:
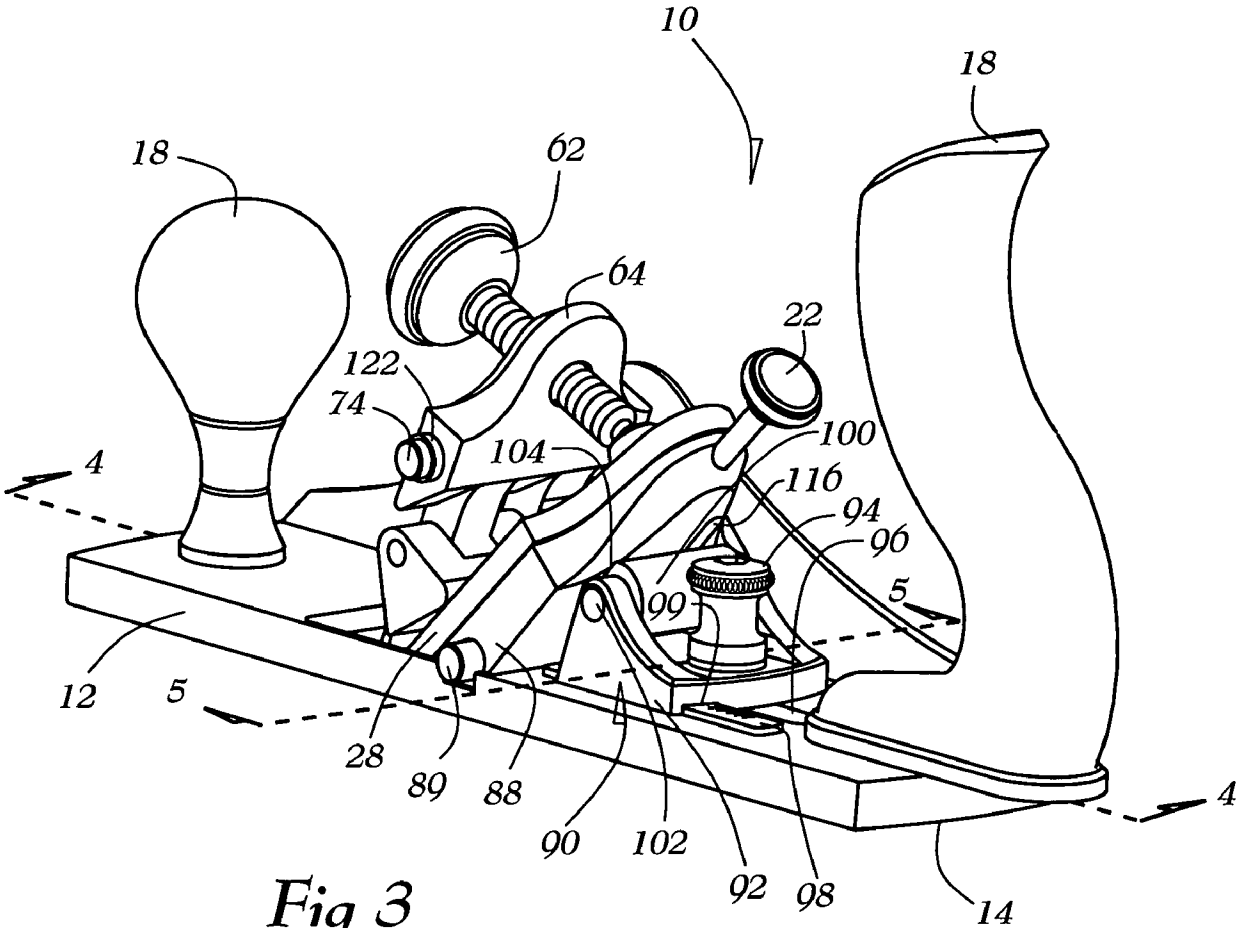
FIG. 3 shows the embodiment of the invention shown in FIG. 2 with a side of the base unit removed.
Figure 4:
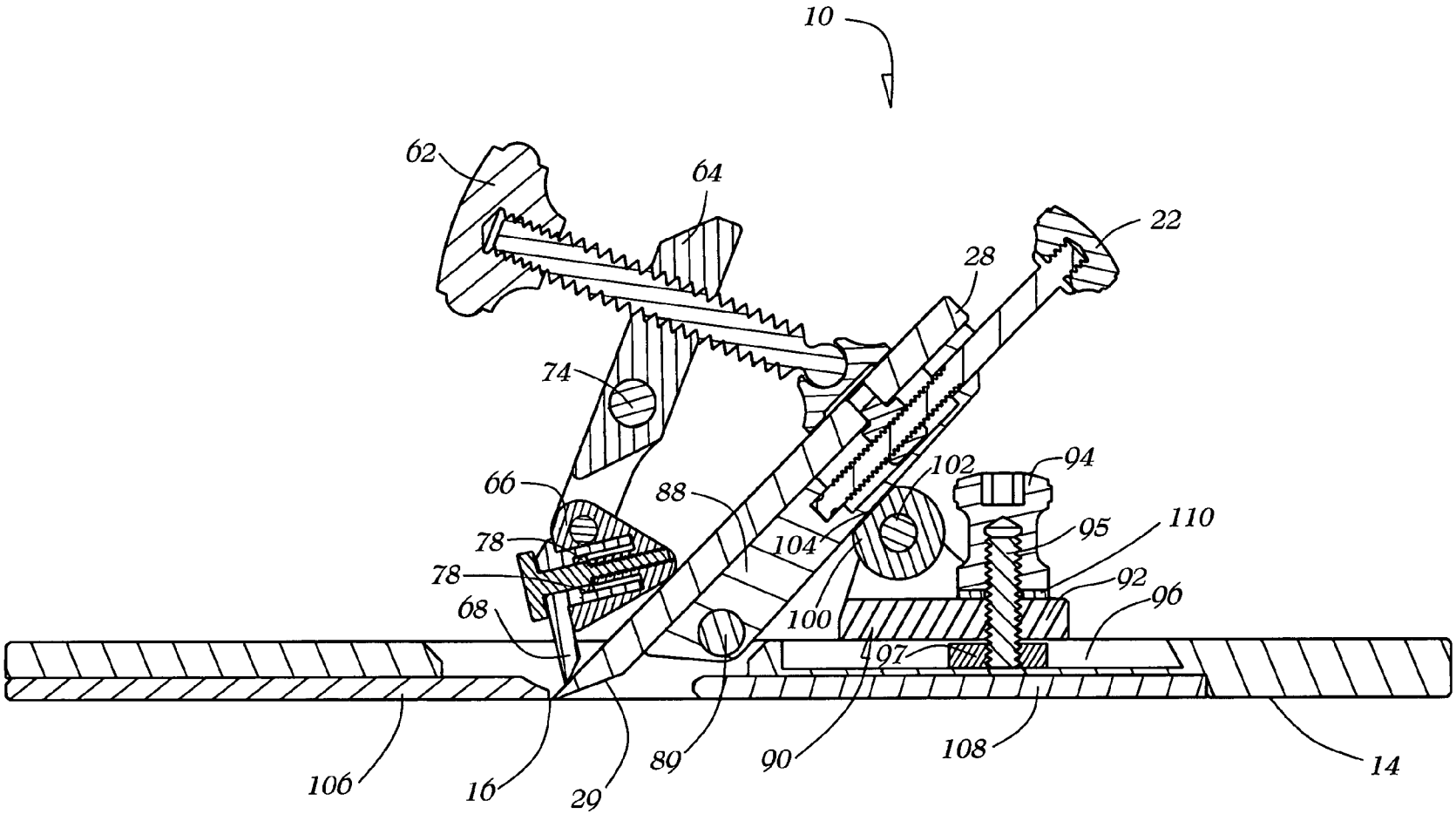
FIG. 4 shows a sectional view of one embodiment of the invention taken along lines 4-4 of FIG. 3.
Figure 5:
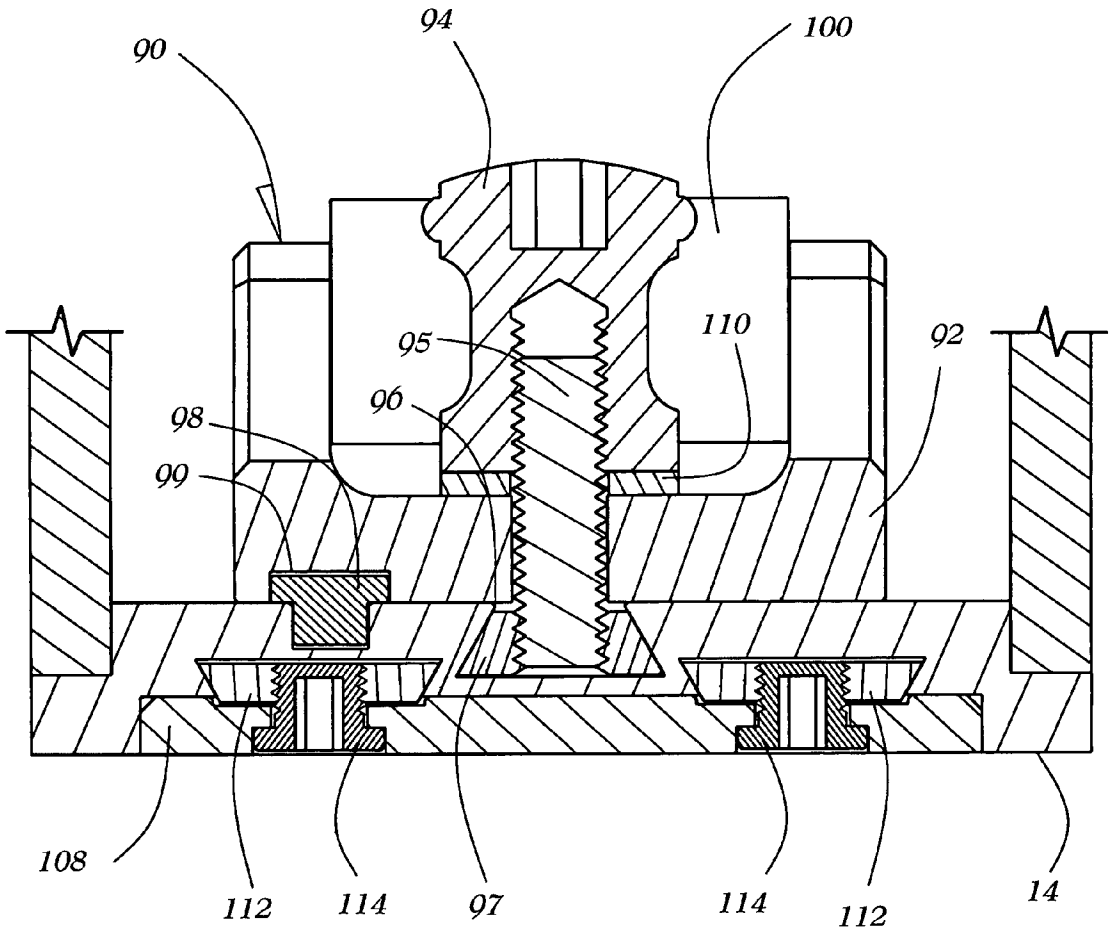
FIG. 5 shows a sectional view of one embodiment of the invention taken along lines 5-5 of FIG. 3.

As seen in FIGS. 2-4, the adjustable frog 88 pivots within the base unit 12 by adjustable frog pivot pins 89. Preferably, there is one adjustable pivot pin 89 which extends out of each side of the adjustable frog 88 and engages corresponding holes within the sides of the base unit 12. In this manner, the adjustable frog 88 is allowed to pivot through a range of angles relative to the sole 14. As the iron 28 engages or rests on the frog 88, the iron 28 correspondingly changes angles with the adjustable frog 88.

Supporting the adjustable frog 88 is a frog stop assembly 90. The frog stop assembly 90 can be constructed in any manner which will allow the adjustable frog 88 to pivot within the base unit 12, but then support the adjustable frog 88 when the iron 28 is tightened down to the adjustable frog 88. One embodiment of the frog stop assembly 90 is shown in FIGS. 2-6. The frog stop body 92 slides axially along the base unit 12. The front assembly 90 tightens to the base unit when a dovetail nut 97 slides within the adjustable frogs slide groove 96 and receives a threaded stud 95, which passes through the frog stop body 92 and tightens with an adjustable frog tightening nut 94. A washer 110 may be placed between the adjustable frog tightening nut 94 and the adjustable frog stop body 92. The dovetail nut 97 has angled sides which slide along corresponding angled sides in the frog slide groove 96. In this way, when the adjustable frog tightening nut 94 is tightened onto the threaded stud 95, the dovetail nut 97 tightens, but cannot pull through the adjustable frog slide groove 96. This allows the frog stop assembly 90 to support the adjustable frog 88 in the desired position. Other designs of an adjustable frog stop 90 are contemplated for supporting the adjustable frog 88.

To keep the adjustable frog stop assembly 90 properly aligned with respect to the adjustable frog 88, an angle indicator groove 99 within the frog stop body 92 rides along a raised member which can be used as an angle indicator 98. The angle indicator 98 preferably has graduations which, when aligned with the back end of the frog stop body 92 indicate the approximate angle of the adjustable frog 88 with respect to the sole 14. Other methods of aligning the adjustable frog stop assembly 90 and other methods of indicating approximate angle of the adjustable frog 88 are contemplated with this invention.

The adjustable frog stop assembly 90 preferably has a frog stop roller 100 which engages the back side of the adjustable frog 88 for supporting the adjustable frog 88. The frog stop roller 100 is preferred to have a flat support surface 104 which contacts the back side of the adjustable frog 88. The frog stop roller 100 has frog stop roller pivots 102 which allow the frog stop roller 100 to adjust to the proper angle so that the support surface 104 can rest flatly against the back side of the adjustable frog 88 as the angle of the adjustable frog 88 changes.

Adjustment of the frog 88 changes the location where the iron 28 extends through the throat 16 of the base unit 12. Therefore, this plane is preferred to have an adjustable throat 16. One method of accomplishing this is shown with both a front adjustable throat plate 106 and a back adjustable throat plate 108. These plates 106, 108 preferably slide linearly along the sole 14 of the base unit 12. Therefore, the adjustable throat plates 106, 108 can be moved to the desired distance from the iron 28 in both the front and back of the iron 28. The adjustable throat plates 106, 108 in this embodiment are held in the proper places in the base unit 12 by one or more throat plate tightening screws 114 which each tighten a dovetail nut 112. The dovetail nuts are preferably constructed with angles which match corresponding angles within a groove on the bottom of the base unit 12. Thus, as the tightening screws 114 tighten to the dovetail nuts 112, the dovetail nuts 112 tighten within the groove in the base unit and prevent further sliding of the adjustable throat plate 106, 108. This can be seen in FIG. 5.

Figure 6C:
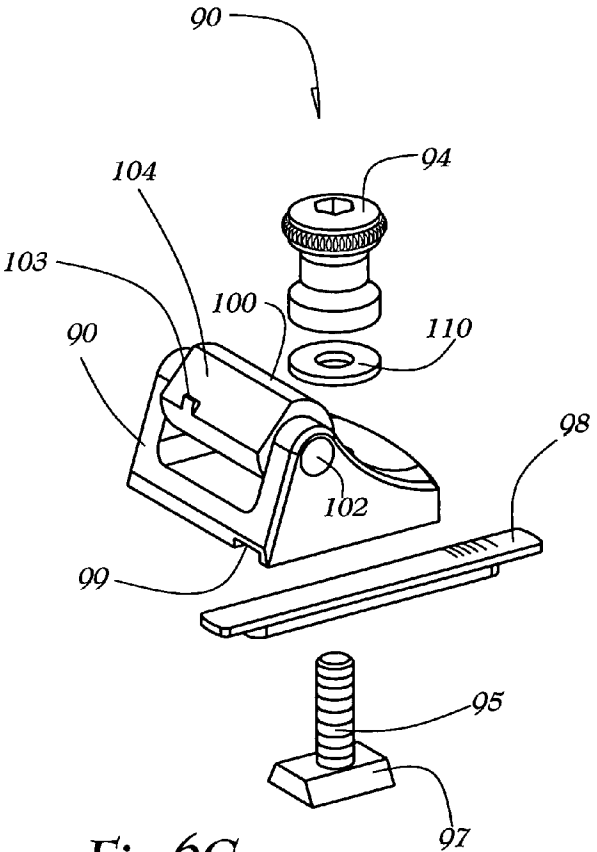
FIG. 6C shows one embodiment of a frog stop assembly.
Figure 6A:
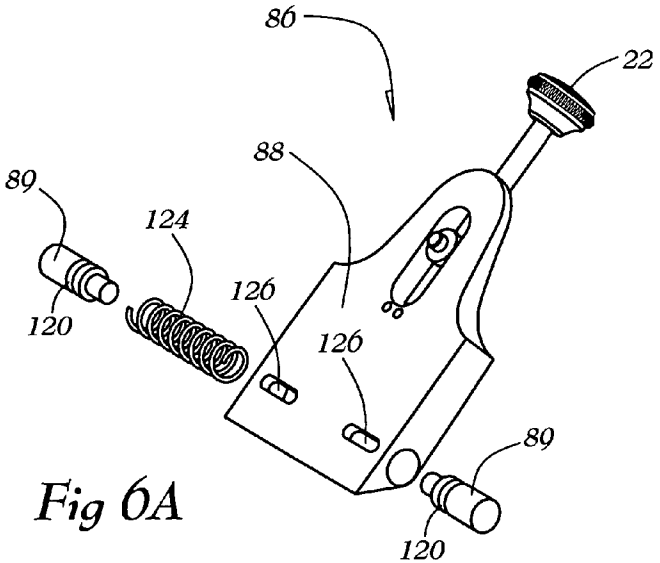
FIG. 6A shows an exploded view of the top of one embodiment of an adjustable frog assembly.
Figure 6B:
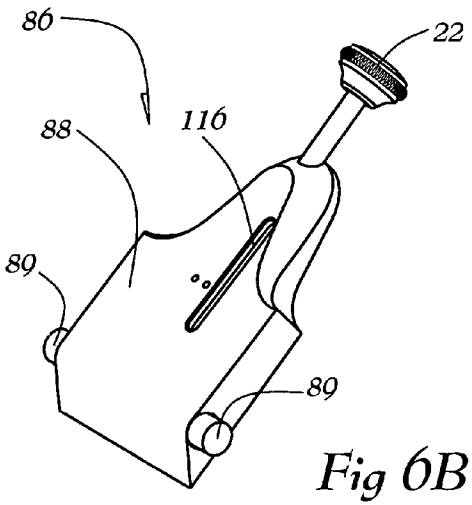
FIG. 6B shows an isometric bottom view of the adjustable frog assembly of FIG. 6A.

Refer now to FIGS. 6A and 6B wherein one embodiment of the adjustable frog assembly 86 is shown. FIG. 6A shows the front side which engages the iron 28. FIG. 6B shows the back side. The adjustable frog 88 preferably has a depth adjuster 22. The depth adjuster 22 is threaded on one end and rotates within the adjustable frog 88. The threaded end causes a pin to travel linearly on the threads of the adjuster 22 when the adjuster 22 is rotated. As this pin travels up and down, it preferably corresponds with a hole or aperture in the iron 28 and causes the iron 28 to travel along the front surface of the adjustable frog 88. With this motion, the iron 28 can be properly positioned to the desired depth through the throat 16 for obtaining a proper thickness of cut. Although preferred, a depth adjuster 22 is not necessary for the current invention.

To allow the adjustable frog 88 to pivot in the base unit 12, the adjustable frog assembly 86 preferably has adjustable frog pivot pins 89 which enter holes on opposite sides of the adjustable frog 88. The pivot pins 89 fit into corresponding holes within the sides of the base unit 12. The pivot pins 89 are held apart and tightly into the holes on the base unit 12 by a spring 24 which pushes apart the pivot pins 89. To insert the adjustable frog assembly 86 into the base unit 12, the pivot pins 89 are configured with a pivot pin groove 120 which can be accessed with a tool, such as needle nose pliers, through the access slots 126 on the adjustable frog 88. The use of the tool allows one to squeeze the pivot pins 89 together, align the pins with the corresponding holes on the sides of the base unit and then release the pivot pins 89 to extend into the holes on the sides of the base unit 12. Thus, the adjustable frog assembly 86 can pivot. The adjustable frog assembly 86 can be aligned with the frog stop assembly 90 by having a frog stop alignment guide 103 on the frog stop roller 100. The frog stop alignment guide 103 aligns with a frog alignment groove 116 on the back side of the adjustable frog 88. Thus, this helps to keep the adjustable frog assembly 86 aligned within the base unit 12.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims. For example, the present invention contemplates variations in structure of the iron, the iron cap, the adjustable frog, the frog stop, the depth adjuster, the totes, the throat, and etc. These and other variations are within the spirit and scope of the invention.

What is claimed is:

1. A hand plane for planing wood comprising:

a base unit having opposite side walls, a sole, and a throat extending through the base unit to the sole;

an iron having a beveled edge extending through the throat of the base unit;

an adjustable frog for supporting the iron, the frog having a first pair of pivot pins extending into the opposite side walls of the base, the first pair of pins defining a first pivot axis, whereby the frog is pivotally mounted on the base unit and adjustable about the first pivot axis between a range of angles with respect to the sole;

an iron cap having a second pair of pivot pins extending into the opposite side walls of the base, the second pair of pins defining a second pivot axis, whereby the iron cap is pivotally mounted on the base unit for pivotal movement about the second pivot axis, the iron cap engaging the iron and securing the iron to the frog; and the first and second pivot axes being spaced apart.

2. The hand plane of claim 1 wherein the adjustable frog pivots between about 30° to about 90° with respect to the sole.

3. The hand plane of claim 1 further comprising a frog stop assembly slidably mounted to the base unit to support the adjustable frog.

4. The hand plane of claim 3 wherein the frog stop assembly slides in a groove in the base unit.

5. The hand plane of claim 1 further comprising an angle indicator that approximately indicates angle of the adjustable frog with respect to the sole.

6. The hand plane of claim 1 further comprising one or more adjustable throat plates connected to the base unit for adjusting size of the throat.

7. The hand plane of claim 1 wherein the adjustable frog further comprises a depth adjuster for adjusting depth of the iron through the throat.

8. The hand plane of claim 1 wherein the beveled edge of the iron is reversible on the frog between bevel-up and bevel-down orientations.

9. A hand plane comprising:

a base unit with a sole and a throat extending through the base unit to the sole;

an adjustable frog pivotally mounted to the base unit for supporting a plane iron at multiple angles with respect to the sole;

an iron cap pivotally mounted to the base unit for securing the plane iron against the adjustable frog to hold the iron in place for cutting wood;

the frog and iron cap being separately mounted to the base; and the frog and the iron cap having spaced apart pivot axes extending through the base unit.

10. The hand plane of claim 9 further comprising a frog stop assembly slidably mounted to the base unit for limiting movement of the adjustable frog.

11. The hand plane of claim 9 further comprising a depth adjuster integrated into the adjustable frog.

12. The hand plane of claim 9 further comprising an angle indicator that approximately indicates angle of the adjustable frog with respect to the sole.

13. The hand plane of claim 9 further comprising one or more adjustable throat plates operatively connected to the base unit for adjusting size of the throat.

14. The hand plane of claim 9 further comprising an adjustable throat plate operatively connected to the base unit rearward of the throat.

15. The hand plane of claim 9 wherein the frog and iron cap are spaced apart from one another.

16. The hand plane of claim 9 wherein the frog and iron cap are each mounted directly to the base unit.

17. A hand plane comprising:

a base unit having opposite sides and a sole, and throat extending through the base unit to the sole:

an angularly adjustable frog having opposing mounting points for directly connecting the frog to the opposite sides of the base unit for supporting a plane iron at a plurality of angles with respect to the sole;

a frog stop directly connected to the base unit for supporting the adjustable frog at the plurality of angles; and an iron cap having opposing mounting points for directly connecting the iron cap to the opposite sides of the base unit for engaging the plane iron and holding the plane iron to the adjustable frog.

18. The hand plane of claim 17 further comprising an angle indicator that approximately indicates angle of the adjustable frog with respect to the sole.

19. The hand plane of claim 17 wherein the throat is adjustable in size.

20. The hand plane of claim 17 wherein the frog is pivotally connected to the base unit.

21. The hand plane of claim 17 wherein the iron cap is pivotally connected to the base unit.

22. The hand plane of claim 17 wherein the frog stop is slidably connected to the base unit.

* * * * *